US009299519B2

(12) United States Patent
Matsui et al.

(10) Patent No.: US 9,299,519 B2
(45) Date of Patent: Mar. 29, 2016

(54) SWITCH

(71) Applicant: KABUSHIKI KAISHA TOSHIBA, Minato-ku (JP)

(72) Inventors: Yuki Matsui, Ota-ku (JP); Yoshiaki Ohda, Yokohama (JP); Masayuki Ando, Kawasaki (JP)

(73) Assignee: KABUSHIKI KAISHA TOSHIBA, Minato-ku (JP)

( * ) Notice: Subject to any disclaimer, the term of this patent is extended or adjusted under 35 U.S.C. 154(b) by 0 days.

(21) Appl. No.: 14/484,499

(22) Filed: Sep. 12, 2014

(65) Prior Publication Data

US 2015/0083691 A1 Mar. 26, 2015

(30) Foreign Application Priority Data

Sep. 20, 2013 (JP) ..... 2013-195041

(51) Int. Cl.

| | |
|---|---|
| ***H01H 33/66*** | (2006.01) |
| ***H01H 33/14*** | (2006.01) |
| ***H01H 33/666*** | (2006.01) |
| ***H01H 7/00*** | (2006.01) |
| *H01H 3/60* | (2006.01) |

(52) U.S. Cl.

CPC ..... *H01H 33/143* (2013.01); *H01H 7/00* (2013.01); *H01H 33/6661* (2013.01); *H01H 33/6662* (2013.01); *H01H 3/60* (2013.01)

(58) Field of Classification Search

CPC ..... H01H 33/66; H01H 71/10; H01H 9/56; H01H 50/62

See application file for complete search history.

(56) References Cited

U.S. PATENT DOCUMENTS

| | | | | |
|---|---|---|---|---|
| 4,434,332 | A | 2/1984 | Yanabu et al. | |
| 4,458,119 | A * | 7/1984 | Hashimoto | H01H 33/143 218/3 |
| 5,347,096 | A * | 9/1994 | Bolongeat-Mobleu | H01H 33/6661 218/84 |
| 7,199,324 | B2 * | 4/2007 | Perret | H01H 33/6661 218/154 |

(Continued)

FOREIGN PATENT DOCUMENTS

| | | |
|---|---|---|
| DE | 100 22 415 A1 | 5/2001 |
| DE | 10 2011 077 790 B3 | 9/2012 |

(Continued)

OTHER PUBLICATIONS

Extended Search Report issued Feb. 4, 2015 in European Patent Application No. 14185030.5.

*Primary Examiner* — Truc Nguyen

(74) *Attorney, Agent, or Firm* — Oblon, McClelland, Maier & Neustadt, L.L.P.

(57) ABSTRACT

A switch includes: a hermetic vessel filled with an insulating medium; an insulating spacer dividing the hermetic vessel into a first heretic space and second heretic space; an electrode fixedly penetrating through the insulating spacer; and a first circuit breaker part inserted between a first conductor and the electrode in the first hermetic space and serially connecting a second conductor in the second heretic space in a closed state, and having a first contact including the electrode and a first driver driving the first contact. The first circuit breaker part is a vacuum circuit breaker having the first contact housed in a vacuum vessel and a second circuit breaker part having the second contact larger in dielectric strength than in the vacuum circuit breaker. In an interrupting operation from the closed state, the first contact and the second contact are opened, and the first contact is closed when or after the second contact is opened.

12 Claims, 11 Drawing Sheets

(56) References Cited

U.S. PATENT DOCUMENTS

| | | | | |
|---|---|---|---|---|
| 2001/0040146 | A1* | 11/2001 | Miyo | H01H 33/662 218/118 |
| 2005/0211675 | A1* | 9/2005 | Perret | H01H 33/6661 218/43 |
| 2010/0288733 | A1* | 11/2010 | Ichikawa | H01H 33/666 218/134 |
| 2012/0160810 | A1* | 6/2012 | Ohtsuka | H02B 13/0354 218/140 |
| 2014/0076851 | A1* | 3/2014 | Yano | H01H 33/40 218/120 |
| 2014/0209569 | A1* | 7/2014 | Miyatake | H01H 33/662 218/134 |
| 2015/0084722 | A1 | 3/2015 | Sugiyama et al. | |

FOREIGN PATENT DOCUMENTS

| | | | |
|---|---|---|---|
| EP | 2 851 919 | A1 | 3/2015 |
| JP | 58-209830 | | 12/1983 |
| JP | 2003-348721 | | 12/2003 |
| JP | 2007-52979 | | 3/2007 |
| JP | 2015-33187 | A | 2/2015 |
| JP | 2015-43656 | A | 3/2015 |
| JP | 2015-56239 | A | 3/2015 |
| JP | 2015-56249 | A | 3/2015 |
| JP | 2015-60778 | A | 3/2015 |
| WO | WO 2013/042566 | A1 | 3/2013 |

* cited by examiner

SWITCH

CROSS-REFERENCE TO RELATED APPLICATIONS

This application is based upon and claims the benefit of priority from Japanese Patent Application No. 2013-195041, filed on Sep. 20, 2013; the entire contents of which are incorporated herein by reference.

FIELD

Embodiments described herein relate generally to a switch.

BACKGROUND

A switch for high voltage responsible for interrupting a fault current has to satisfy the following two items when interrupting the current.

One is to surely extinguish, in a very short time, an arc generated between contacts after the opening. The other is to prevent dielectric breakdown when a transient recovery voltage rapidly rises between the contacts after the arc extinction.

In recent years, there has been widely adopted a puffer switch of a type in which one circuit breaker part having connectable/separable contacts are housed in a pressure vessel in which SF6 gas as insulating gas is sealed, and the insulating gas is sprayed to the contacts at the time of an interrupting operation, to extinguish an arc.

In this type, the aforesaid two items have to be achieved with a single circuit breaker.

On the other hand, there has also been developed a switch of a type that achieves the interruption of the fault current by connecting circuit breaker parts each specialized in satisfying one of the aforesaid two items.

That is, this is a switch of a type having the plural circuit breaker parts and assigning the roles separately to the respective circuit breaker parts.

Such a switch is formed by separating an inner space of a pressure vessel, housing the circuit breaker part excellent in arc extinction performance and the circuit breaker part excellent in insulation performance in the one and other parts of the space respectively, and electrically connecting the both in series.

In the above-described circuit breaker parts, when the circuit breaker parts are simply opened at the time of current interruption, a transient recovery voltage according to electrostatic capacitance of each of the circuit breaker parts is applied between contacts of the circuit breaker parts after the arc extinction.

Therefore, insulation performance of the switch depends on insulation performance of the circuit breaker part poorer in insulation performance, so that the original object to assign the roles separately to the respective circuit breaker parts cannot be achieved.

A switch according to this embodiment has an object to provide a switch which is capable of easily achieving an interruption duty required for a high-voltage switch and whose interruption time is short.

DETAILED DESCRIPTION

Figure 1:
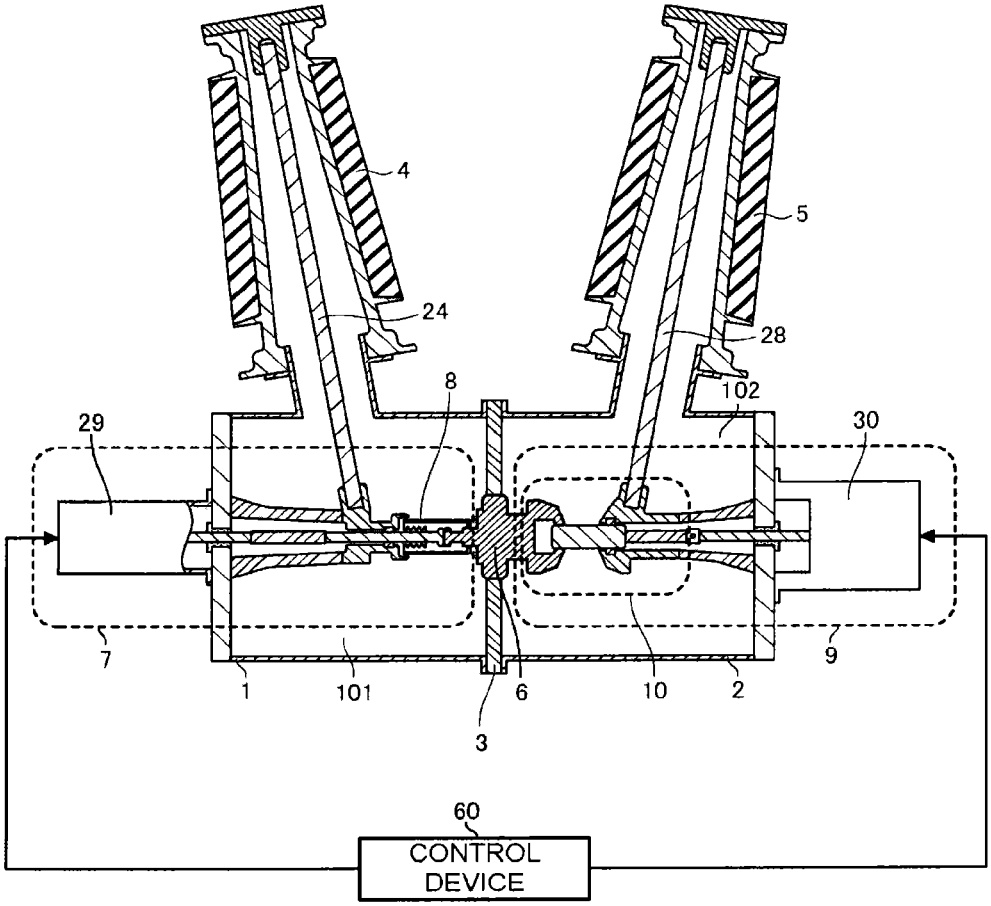
FIG. 1 is a cross-sectional view illustrating the whole structure of a switch according to a first embodiment, and illustrates a closed state.

According to one embodiment, a switch includes a hermetic vessel, an insulating spacer, an electrode, conductors, and a plurality of circuit breaker parts.

The hermetic vessel is filled with an insulating medium.

The insulating spacer divides the inside of the hermetic vessel into a plurality of heretic spaces.

The electrode penetrates through and is fixed to the insulating spacer.

The conductors are led into the hermetic spaces respectively.

The plural circuit breaker parts are inserted between the conductors and the electrode in the hermetic spaces and connect the conductors in series in a closed state.

The circuit breaker parts each have a contact including the electrode and an operation part which drives the contact At least one circuit breaker part out of the plural circuit breaker parts is a vacuum circuit breaker in which the contact is housed in a vacuum vessel.

At least another circuit breaker part out of the plural circuit breaker parts is a circuit breaker part having the contact larger in dielectric strength than the contact in the vacuum circuit breaker.

When performing an interrupting operation from the closed state, the operation parts open the contact of the vacuum circuit breaker and the contact of the other circuit breaker part, and the operation part of the vacuum circuit breaker waits for the contact of the other circuit breaker part to open and then closes the contact of the vacuum circuit breaker.

First Embodiment (Whole Structure)

Hereinafter, the structure of a switch of this embodiment will be described with reference to FIG. 1 to FIG. 7.

The switch of the first embodiment has a plurality of circuit breaker parts in which a plurality of contacts are electrically connected in series and by connecting/separating the contacts, it switches over between an open state where a current is stopped and a closed state where the current is admitted to flow.

The switch of this embodiment includes: pressure vessels 1, 2 made of grounded metal, insulator, or the like; bushings 4, 5 connected to the pressure vessels 1, 2; a plurality of (two here) circuit breaker parts 7, 9 having a pair of connectable/separable contacts; an insulating spacer 3 dividing the inside of the pressure vessels 1, 2 into the same number of (two here) spaces as the number of the circuit breaker parts 7, 9; a fixed electrode 6 penetrating through the insulating spacer 3 and fixed to the insulating spacer 3; and conductors 24, 28.

The pressure vessels 1, 2 are cylindrical vessels each having one surface bottomed and an opposed surface opened, and having a flange portion along an open end portion.

The pressure vessels 1, 2 form a hermetic vessel (hermetic space), with their facing flange portions being fastened together across the insulating spacer 3 and with openings of their other ends being closed by disk-shaped plate members (partition walls).

The conductors 24, 28 are led into the hermetic spaces separated by the insulating spacer 3.

The circuit breaker parts 7, 9 have contacts including electrodes, and operation parts 29, 30 which drive the opening/closing of the contacts. the operation part 29 is a first driver. the operation part 30 is a second driver.

The plural circuit breaker parts 7, 9 are inserted between the conductors 24, 28 and the electrode in the respective hermetic spaces and connect the conductors 24, 28 in series in the closed state.

The contact of the circuit breaker part 7 is housed in the pressure vessel 1 and the contact of the circuit breaker part 9 is housed in the pressure vessel 2, and they are electrically connected in series via the fixed electrode 6 fixed to the insulating spacer 3.

In the bushing 4, the conductor 24 is disposed so as to extend toward the circuit breaker part 7.

In the bushing 5, the conductor 28 is disposed so as to extend toward the circuit breaker part 9.

The conductor 24 and the conductor 28 are electrically connected to the contact of the circuit breaker part 7 and the contact of the circuit breaker part 9 respectively.

A control device 60 is connected to the operation parts 29, 30.

The control device 60 monitors states of the circuit breaker parts 7, 9 and according to the states, outputs a command signal for current interruption, a command signal for current conduction, and so on to the operation parts 29, 30.

The control device 60, for example, detects positions of movable electrodes to monitor states of the contacts (the open state or the closed state), thereby finding the states of the circuit breaker parts 7, 9.

Alternatively, the control device 60 may find the states of the circuit breaker parts 7, 9 by monitoring the current supplied to the operation parts 29, 30.

Under the control by the control device 60, when performing an interrupting operation from the closed state, the operation parts 29, 30 open the contact of the circuit breaker part 7 and the contact of the other circuit breaker part 9, and the operation part 29 waits for the contact of the other circuit breaker part 9 to open and then closes the contact of the circuit breaker part 7.

In other words, when the operation parts 29, 30 open the contacts respectively for an open operation from a closed state, the operation part 29 closes the contact of the circuit breaker part 7 (the first contact) after the contact of the other circuit breaker part 9, (the second contact) is opened by the operation part 30.

(Flow of Current)

When the switch is in the closed state, the current is led from the conductor 24 in the bushing 4.

The current passes through the conductor 24 and sequentially passes through the contact of the circuit breaker part 7, the fixed electrode 6, the contact of the circuit breaker part 9, and the conductor 28, to be led out to the conductor 28 in the bushing 5.

Further, when the switch is in the open state, the contact of the circuit breaker part 7 is closed (in a connection state) and the contact of the circuit breaker part 9 is opened (in a separation state), so that the current is interrupted.

Hereinafter, a detailed structure of the switch of the first embodiment will be described.

(Detailed Structure)

(Inner Spaces 101, 102)

An inner space 101 is formed by the pressure vessel 1, the insulating spacer 3, and the bushing 4, and an inner space 102 is formed by the pressure vessel 2, the insulating spacer 3, and the bushing 5.

The inner spaces 101, 102 are in a hermetic state, and in this embodiment are in a completely hermetic state.

These inner spaces 101, 102 refer to hermetic spaces filled with an insulating medium.

As the insulating medium, sulfur hexafluoride gas (SF6 gas) is used, for instance.

Alternatively, as the insulating medium, carbon dioxide, nitrogen, dry air, or mixed gas of these, insulating oil, or the like may be used, for instance.

Pressures of the inner space 101 and the inner space 102 may be different or equal as required.

In this embodiment, the pressure of the gas in the inner space 101 is not higher than the pressure of the gas in the inner space 102 nor lower than an atmospheric pressure.

(Circuit Breaker Part 7)

The circuit breaker part 7 is a vacuum circuit breaker in which the electrodes are housed in a vacuum vessel with a high vacuum degree, and interrupts the current by utilizing an excellent arc extinction property of the high vacuum.

Hereinafter, it is assumed that the circuit breaker part 7 is the vacuum circuit breaker 7.

The vacuum circuit breaker 7 includes: a vacuum valve 8 having the contact; the operation part 29 which drives this contact; a coupling part 32 which transmits a driving force of the operation part 29 to the contact; and a support part 34 which is connected to one end of the vacuum valve 8 whose other end is connected to the fixed electrode 6 and fixedly supports the vacuum valve 8 in the pressure vessel 1.

The vacuum valve 8 has a cylindrical vacuum vessel **8*a* whose inner part has a high vacuum, and this vacuum vessel 8*a* is housed in the pressure vessel 1**.

This vacuum vessel **8*a* is an insulating cylinder made of, for example, glass, ceramic, or the like. In the vacuum vessel 8*a*, a pair of fixed electrode 11 and movable electrode 14 forming the contact, and a bellows 31** are housed.

The fixed electrode 11 and the movable electrode 14 are disposed to face each other.

The fixed electrode 11 is fixed to the fixed electrode 6 fixed to the insulating spacer 3 and the movable electrode 14 is mechanically connectable/separable to/from the fixed electrode 11.

When the movable electrode 14 separates from the fixed electrode 11, an arc is generated between the both electrodes 11, 14.

The movable electrode 14 has one end facing the fixed electrode 11 and the other end penetrating through a wall surface of the vacuum vessel 8*a* and extending out of the wall surface.

The bellows 31 is expandable/contractible, and keeps the inside of the vacuum vessel 8*a* airtight even when the movable electrode 14 is connected/separated to/from the fixed electrode 11.

The coupling part 32 is composed of a rod-shaped insulating rod 13 made of an insulating member and a rod-shaped operation rod 15 made of a conductive member.

The insulating rod 13 and the operation rod 15 are disposed coaxially with the fixed electrode 11 and the movable electrode 14.

The insulating rod 13 has one end connected to the movable electrode 14 and the other end connected to the operation rod 15 and extends in the pressure vessel 1.

The operation rod 15 penetrates through a wall surface of the pressure vessel 1 from the insulating rod 13, extends to the outside of the pressure vessel 1, and is connected to the operation part 29.

The operation part 29 is disposed outside the pressure vessel 1 and drives the contact to be capable of bringing the contact into the connection/separation states.

That is, by the driving force of the operation part 29, the operation rod 15 and the insulating rod 13 are pushed/pulled on one straight line, so that the movable electrode 14 is connectable/separable to/from the fixed electrode 11.

Incidentally, the driving of the operation part 29 can be started according to the command signal from the control device installed outside the switch, for instance.

On a portion of the wall surface of the pressure vessel 1 through which the operation rod 15 penetrates, a sealing part 16 having a not-illustrated elastic packing is provided.

The inner space 101 is kept airtight even when the operation rod 15 is in slide contact with the packing of the sealing part 16.

The support part 34 has one end fixed to the wall surface of the pressure vessel 1 on which the sealing part 16 is provided and the other end connected to the vacuum vessel 8*a* of the vacuum valve 8.

This support part 34 is roughly composed of: an insulating support portion 21 surrounding the insulating rod 13 and extending from the wall surface of the pressure vessel 1 on which the sealing part 16 is provided toward the insulating spacer 3; and a conductive support portion 22 having one end connected to the insulating support portion 21 and the other end connected to the vacuum vessel 8*a*.

The insulating support portion 21 and the conductive support portion 22 are provided concentrically so as not to be in contact with the insulating rod 13 and the operation rod 15.

Between the conductive support portion 22 and the movable electrode 14, a conductive contactor 23 made of a conductive member is disposed, being electrically connected to the both.

The movable electrode 14 is slidable by the operation part 29.

In the vacuum valve 8, one end of the vacuum vessel 8*a* is fixed to the fixed electrode 11.

The other end of the vacuum vessel 8*a* is fixed to the support part 34.

(Circuit Breaker Part 9)

As the circuit breaker part 9, a puffer-type gas circuit breaker part or a non-puffer-type gas circuit breaker part is usable.

The puffer-type gas circuit breaker part has electrodes forming a contact, a puffer cylinder which accumulates pressures for spraying insulating gas to the arc, and a nozzle which guides the spraying of the insulating gas to the arc.

In an interrupting operation and a conducting operation, the operation part drives these members in linkage with the electrodes.

On the other hand, the non-puffer-type gas circuit breaker part does not have such a puffer cylinder or nozzle.

The circuit breaker part 9 of this embodiment is a gas circuit breaker part of the non-puffer type which is higher in dielectric strength than the vacuum circuit breaker 7 and is capable of high-speed driving.

Hereinafter, it is assumed that the circuit breaker part 9 is the gas circuit breaker part 9.

The gas circuit breaker part 9 includes the contact 10, the operation part 30 which drives the contact 10, a coupling part 33 which transmits a driving force of the operation part 30 to the contact 10, and a support part 35 which defines a movement direction of the contact 10.

The contact 10 of the gas circuit breaker part 9 is higher in dielectric strength than the contact that the vacuum valve 8 of the vacuum circuit breaker 7 has.

This contact 10 is composed of a pair of fixed electrode 12 and movable electrode 18 disposed to face each other in the pressure vessel 2.

The fixed electrode 12 is fixed to the fixed electrode 6, and the movable electrode 18 is mechanically connectable/separable to/from the fixed electrode 12.

What make the movable electrode 18 mechanically connectable/separable are the coupling part 33 and the operation part 30.

The coupling part 33 is composed of a rod-shaped insulating rod 17 made of an insulating member and a rod-shaped operation rod 19 made of a conductive member.

The insulating rod 17 and the operation rod 19 are disposed coaxially with the fixed electrode 12 and the movable electrode 18.

The insulating rod 17 has one end connected to the movable electrode 18 and the other end connected to the operation rod 19, and extends in the pressure vessel 2.

The operation rod 19 penetrates from the insulating rod 17 through a wall surface of the pressure vessel 2, extends to the outside of the pressure vessel 2, and is connected to the operation part 30.

The operation part 30 is disposed outside the pressure vessel 2 and drives the contact 10 to be capable of bringing the contact 10 into the connection/separation states.

That is, by the driving force of the operation part 30, the operation rod 19 and the insulating rod 17 are pushed/pulled on one straight line, so that the movable electrode 18 is connected/separated to/from the fixed electrode 12.

Incidentally, the driving of the operation part 30 can be started according to the command signal from the control device 60 installed outside the switch, for instance.

On a portion of the wall surface of the pressure vessel 2 through which the operation rod 19 penetrates, a sealing part 20 having a not-illustrated elastic packing is provided.

The inner space 102 is kept airtight even when the operation rod 19 is in slide contact with the packing of the sealing part 20.

The support part 35 has one end fixed to the wall surface of the pressure vessel 1 on which the sealing part 20 is provided and the other end connected to the movable electrode 18.

This support part 35 is roughly composed of: an insulating support portion 25 surrounding the insulating rod 17 and extending from the wall surface of the pressure vessel 1 on which the sealing part 20 is provided, toward the insulating spacer 3; and a conductive support portion 26 having one end connected to the insulating support portion 25 and the other end connected to the movable electrode 18.

The insulating support portion 25 and the conductive support portion 26 are provided concentrically so as not to be in contact with the insulating rod 17 and the operation rod 19.

Between the conductive support portion 26 and the movable electrode 18, a conductive contactor 27 made of a conductive member is disposed so as to be electrically connected to the both, and the movable electrode 18 is slidable by the operation part 30.

Hereinafter, the operation of the switch will be described with reference to FIG. 3 to FIG. 7.

First, the operations of the circuit breaker parts 7, 9 will be described.

Figure 3:
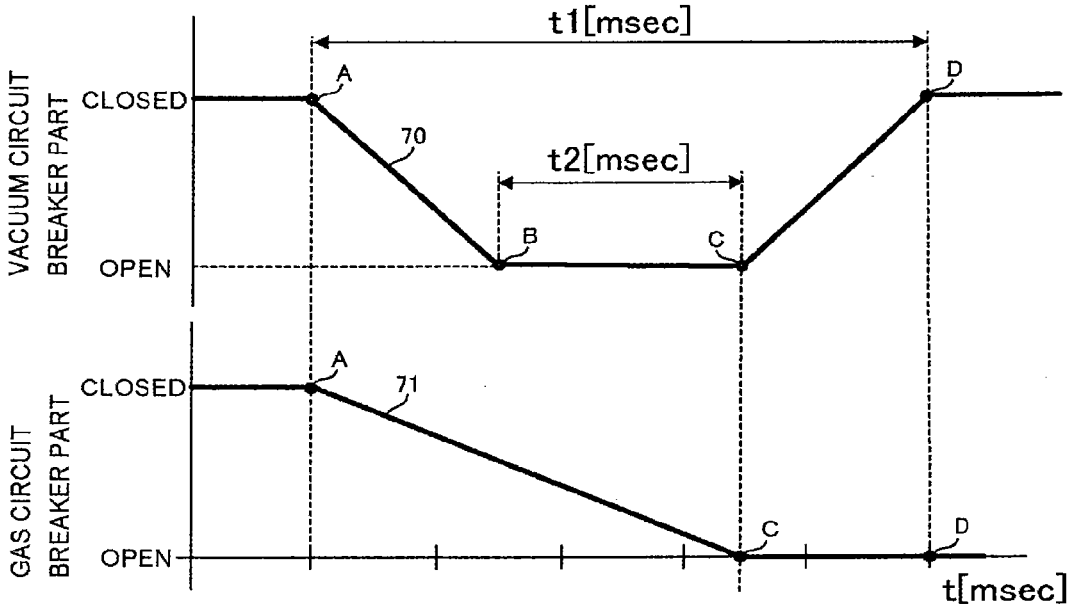
FIG. 3 is a sequence chart illustrating opening/closing operations of contacts of respective circuit breaker parts.

FIG. 3 is a sequence chart illustrating opening operations (interrupting operations) of the circuit breaker parts 7, 9 of this switch.

As illustrated in FIG. 3, when the vacuum circuit breaker 7 and the gas circuit breaker part 9 start the opening operation from the closed state of the switch at a timing of, for example, point A, the contact (movable electrode 14) of the vacuum valve 8 starts separating at a high speed, to reach the open state at a timing of point B as indicated by line 70.

On the other hand, even when the gas circuit breaker part 9 starts the opening operation at the same timing of the point A at which the vacuum circuit breaker 7 starts the opening operation, it reaches the open state at a timing of point C after starting the opening operation as indicated by line 71 because a mass of the gas circuit breaker part 9 is heavy and its sliding portion is on the contact 10, and thus the operation of the contact 10 (movable electrode 18) is slower than that of the vacuum valve 8.

In the vacuum circuit breaker 7, since the contact of the vacuum valve 8 is opened earlier, the open state is maintained during a period t2 between the point B and the point C, and the vacuum circuit breaker 7 waits for the gas circuit breaker part 9 to open and then starts the closing operation at the timing of the point C and is closed at a timing of point D.

Consequently, a total interruption time t1 in this switch can be shortened to the order of several msec.

Incidentally, in this example, the closing start timing of the vacuum circuit breaker 7 is the point C, but the vacuum circuit breaker 7 only needs to be closed at or after the opening of the gas circuit breaker part 9, and the closing operation of the vacuum circuit breaker 7 may be started at a timing before the point C.

Here, the flow of the current and a concrete operation of the contacts will be described.

(Closed State)

Figure 2:
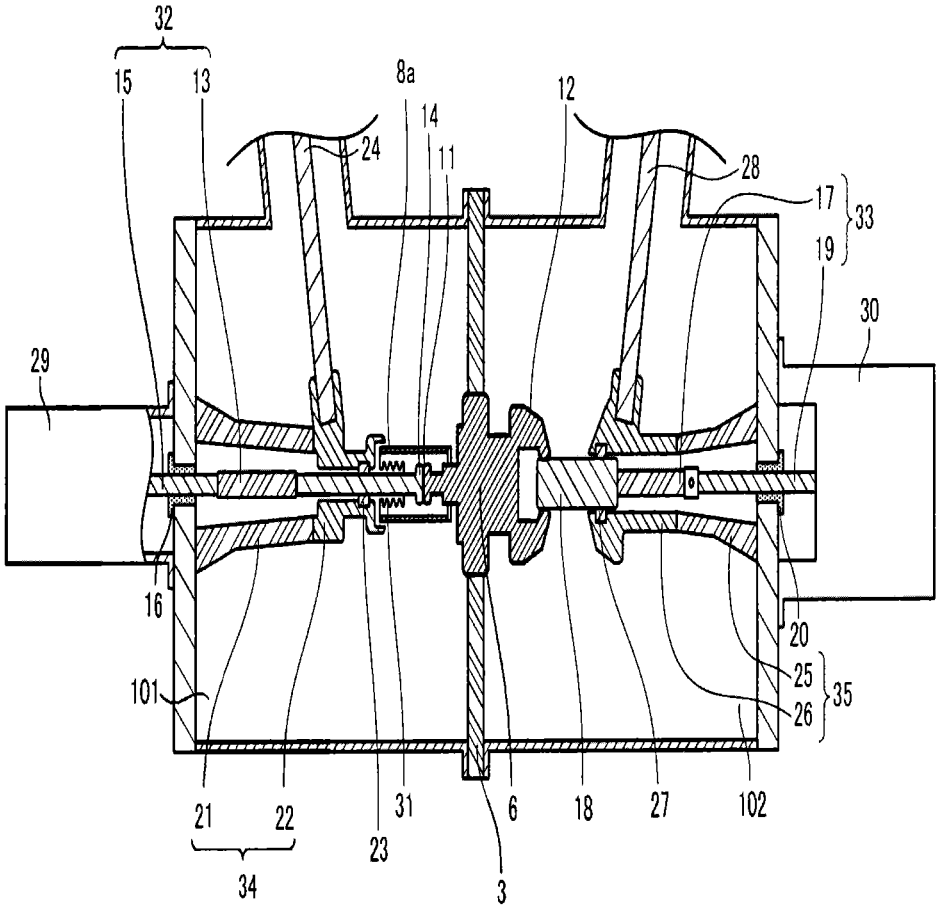
FIG. 2 is an enlarged cross-sectional view of part of FIG. 1.

When the switch is in the closed state as illustrated in FIG. 1 and FIG. 2, the current led from the bushing 4 is led out to the bushing 5 sequentially through the conductor 24, the conductive support portion 22, the conductive contactor 23, the movable electrode 14, the fixed electrode 11, the fixed electrode 6, the fixed electrode 12, the movable electrode 18, the conductive contactor 27, the conductive support portion 26, and the conductor 28.

(Opening Operation)

On the other hand, when the command signal for the current interruption is given to the operation parts 29, 30 of the switch from the control device 60, the driving forces (thrusts) large enough for the movable electrodes 14, 18 to separate from the fixed electrodes 11, 12 are generated from the operation parts 29, 30, so that the movable electrodes 14, 18 separate simultaneously from the fixed electrodes 11, 12 to start the current interruption.

Figure 4:
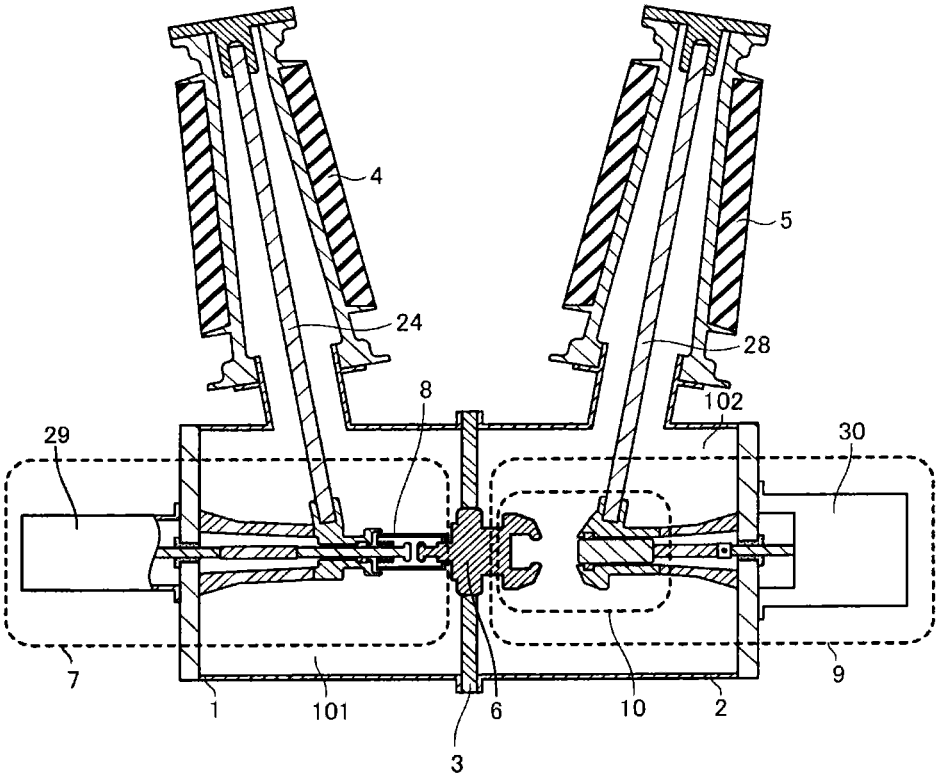
FIG. 4 is a view illustrating the switch of the first embodiment during an opening operation.
Figure 5:
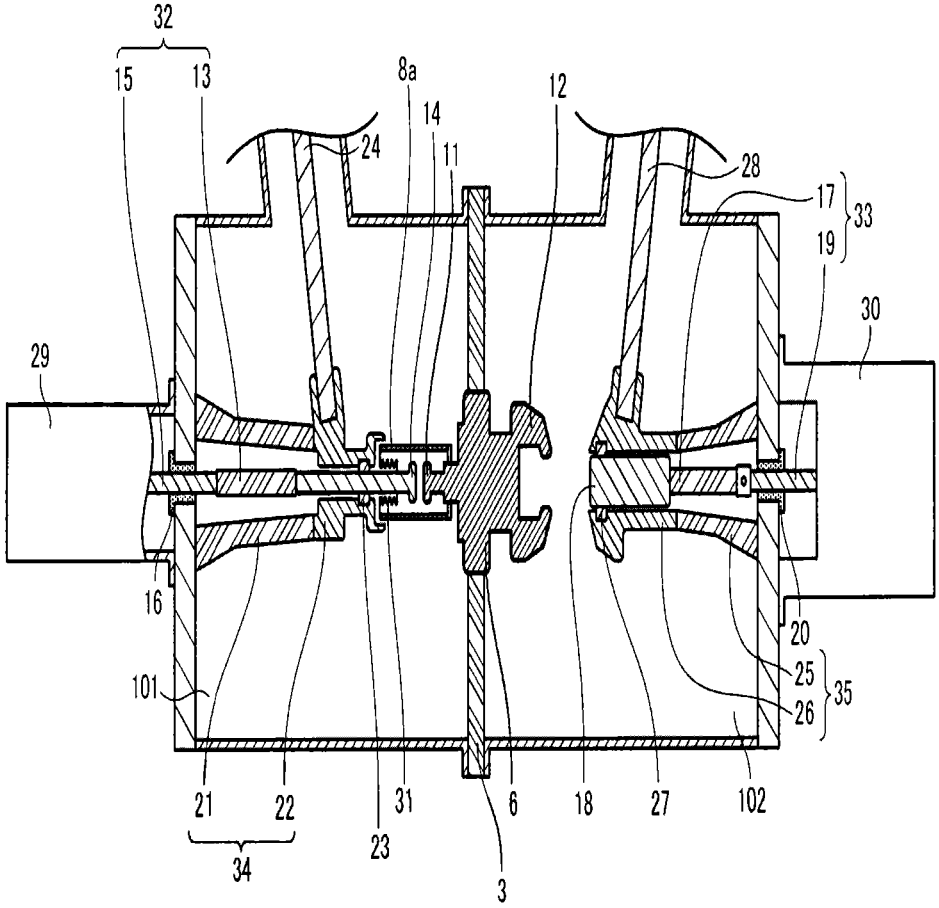
FIG. 5 is an enlarged cross-sectional view of part of FIG. 4.

Concretely, as illustrated in FIG. 4, and FIG. 5, in the vacuum circuit breaker 7, the movable electrode 14 of the vacuum valve 8 moves in such a direction as to be apart from the fixed electrode 11 to separate from the fixed electrode 11.

In the course of the above, between the fixed electrode 11 and the movable electrode 14, the arc made of particles and electrons evaporated from the electrodes is generated, but since the inside of the vacuum vessel 8*a* has a high vacuum degree, the substances forming the arc diffuse and cannot retain their shape to extinguish. Consequently, the flowing current is interrupted.

On the other hand, in the gas circuit breaker part 9, the movable electrode 18 separates from the fixed electrode 12 and the arc is generated between the both electrodes 12, 18, but the arc is extinguished if an insulation distance is ensured between the both electrodes 12, 18.

Figure 6:
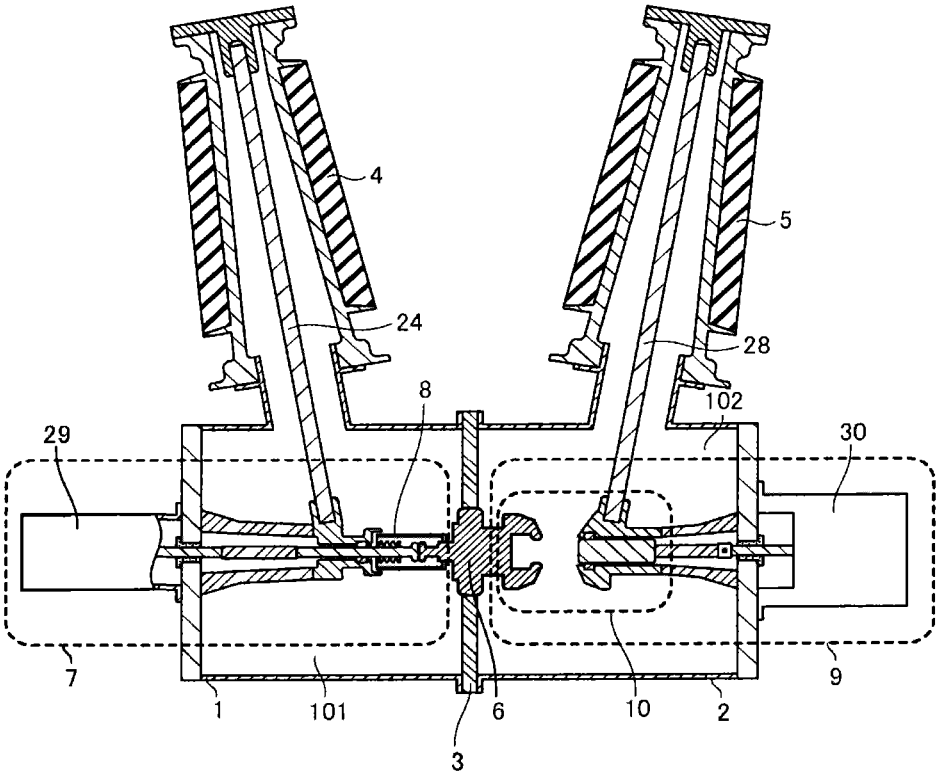
FIG. 6 is a view illustrating the switch of the first embodiment in an open state.
Figure 7:
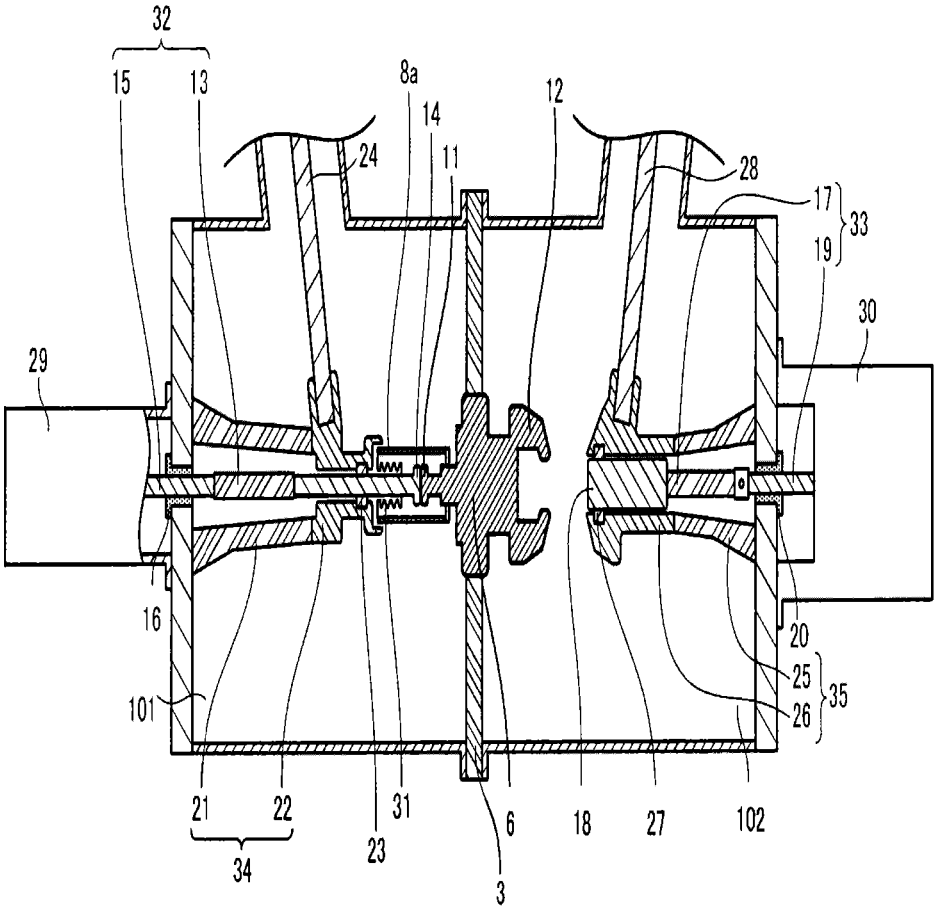
FIG. 7 is an enlarged cross-sectional view of part of FIG. 6.

Further, immediately after the opening of the gas circuit breaker part 9, in the vacuum circuit breaker 7, the movable electrode 14 of the vacuum valve 8 moves in a closing direction due to the driving force from the operation part 29, and as illustrated in FIG. 6 and FIG. 7, the movable electrode 14 comes into contact with the fixed electrode 11.

In this interrupting process, separated gas is generated from the SF6 gas by the arc in the inner space 102.

This separated gas has an action to corrode a surface layer of the vacuum vessel 8*a* made of the insulator, of the vacuum valve 8, but since the vacuum vessel 8*a* is housed in the hermetically sealed inner space 101, there is no concern about the corrosion of the vacuum vessel 8*a* by the separated gas generated in the inner space 102.

Incidentally, the vacuum valve 8 includes the bellows 31 poor in high-pressure resistance, and the pressure of the gas in the inner space 101 is set to a pressure not higher than the gas pressure in the inner space 102 nor less than the atmospheric pressure, which is a pressure bearable by the bellows 31.

Consequently, the bellows 31 in the inner space 101 is protected while dielectric strength at the contact of the inner space 102 is ensured.

(Effects)

As described above, according to the switch of the first embodiment, in the process of the interruption, the vacuum circuit breaker 7 takes on the duty of interrupting the fault current, and the gas circuit breaker part 9 high in dielectric strength takes on the duty of interrupting the high transient recovery voltage generated after the current interruption, whereby it is possible to surely achieve the two interruption duties. In this embodiment, the following effects can be obtained besides this effect.

(1) The switch of this embodiment is capable of easily bringing the contacts into the connection/separation (open) state at a high speed since the vacuum circuit breaker 7 and the gas circuit breaker part 9 have their own contacts and operation parts 29, 30 driving the contacts and accordingly a load to each of the operation parts 29, 30 is reduced.

(2) The circuit breaker parts 7, 9 have the operation parts 29, 30 disposed outside the pressure vessels 1, 2 and further have the coupling parts 32, 33 which transmit the driving forces of the operation parts 29, 30 to the contacts.

The coupling parts 32, 33 are structured to penetrate through the pressure vessels 1, 2 while keeping the inside of the pressure vessels 1, 2 airtight, to be connected to the operation parts 29, 30, and therefore, the operation parts 29, 30 never come into direct contact with the separated gas generated from the SF6 gas by the arc in the course of the interruption, which can prevent the separated gas from corroding the operation parts 29, 30.

(3) At least one circuit breaker part 7 out of the plural circuit breaker parts 7, 9 is formed as the vacuum circuit breaker 7 having the vacuum valve 8 including the contact, and at least one circuit breaker part 9 is formed as the gas circuit breaker part 9 having the contact 10 larger in dielectric strength than the contact of the vacuum valve 8.

Then, in the course of the interruption, after the vacuum circuit breaker 7 and the gas circuit breaker part 9 are opened, only the vacuum circuit breaker 7 is closed.

Consequently, the interruption of the fault current is executed by the vacuum circuit breaker 7, and the gas circuit breaker part 9 high in dielectric strength is loaded with the high transient recovery voltage generated after the current interruption, which can easily achieve the interruption duties.

By thus providing at least one vacuum circuit breaker 7 and at least one gas circuit breaker part 9, the current interruption and the voltage proof can be achieved separately by the respective circuit breaker parts.

(4) Further, since the vacuum valve 8 of the vacuum circuit breaker 7 has the contact-type contact and the weight of the movable electrode 14 is small, the interrupting operation can be performed in a very short time.

Further, since the gas circuit breaker part 9 has the dedicated operation part also as the puffer-type gas circuit breaker part, the load per one operation part is reduced as the whole switch, which can open the contact at a high speed.

Further, since, in the gas circuit breaker part 9 of this embodiment, the movable electrode 18 has no puffer cylinder or nozzle, a weight of movable parts driven by the operation part 30 is reduced as compared with a puffer-type circuit breaker part.

Consequently, since the operation part 30 is capable of driving the movable electrode 18 at a higher speed, it is possible to greatly reduce the time necessary for ensuring the insulation distance.

As described above, as compared with a conventional switch having a plurality of puffer-type circuit breaker parts, the switch of this embodiment is capable of performing the current interruption and ensuring the insulation distance in a shorter time, which can shorten the interruption time.

(5) Since the switch of this embodiment has the structure in which the inner space 101 and the inner space 102 are hermetically sealed, their pressures can be independently set to different pressures.

Concretely, the pressure of the gas in the inner space 101 is set not higher than the gas pressure in the inner space 102 nor lower than the atmospheric pressure.

Consequently, it is possible to protect the bellows 31 in the inner space 101 while ensuring the dielectric strength at the contact of the inner space 102.

Second Embodiment (Structure)

A second embodiment will be described with reference to FIG. 8 to FIG. 13.

A basic structure of the second embodiment is the same as that of the first embodiment.

In this second embodiment, what are different from the first embodiment will be described, and the same parts as those of the first embodiment will be denoted by the same reference signs, and detailed description thereof will be omitted.

A switch according to the second embodiment has an electromagnetic repulsion operation part 41 instead of the operation part 29 of the vacuum circuit breaker 7 described in the first embodiment.

The electromagnetic repulsion operation part 41 is a contact opening/closing mechanism utilizing an electromagnetic repulsive force and has high responsiveness in an opening operation of a contact 10.

Figure 8:
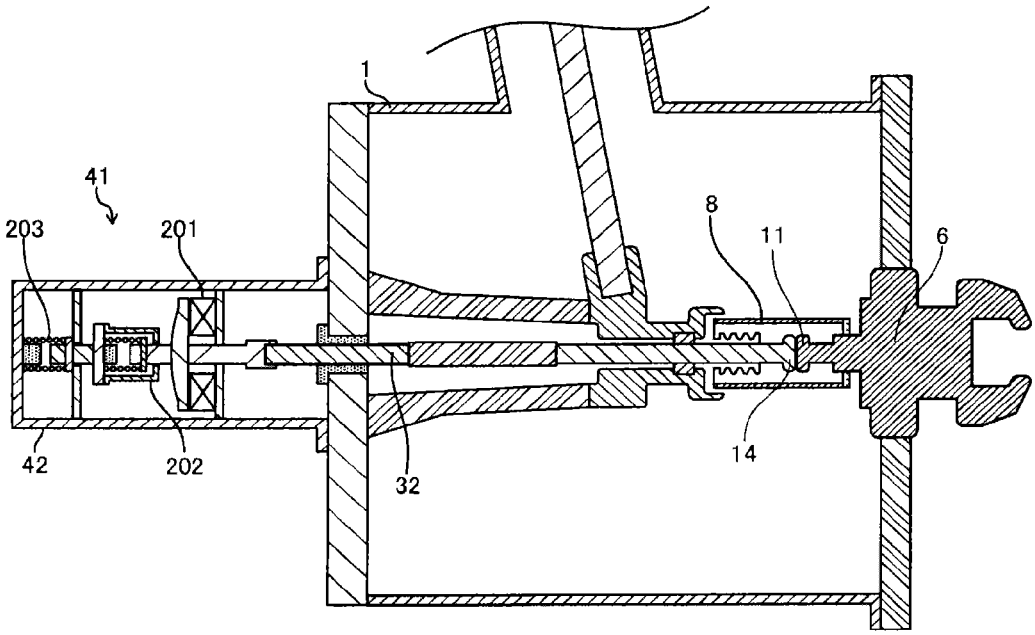
FIG. 8 is a cross-sectional view illustrating the whole structure of a vacuum circuit breaker of a switch according to a second embodiment, and illustrates a closed state.
Figure 9:
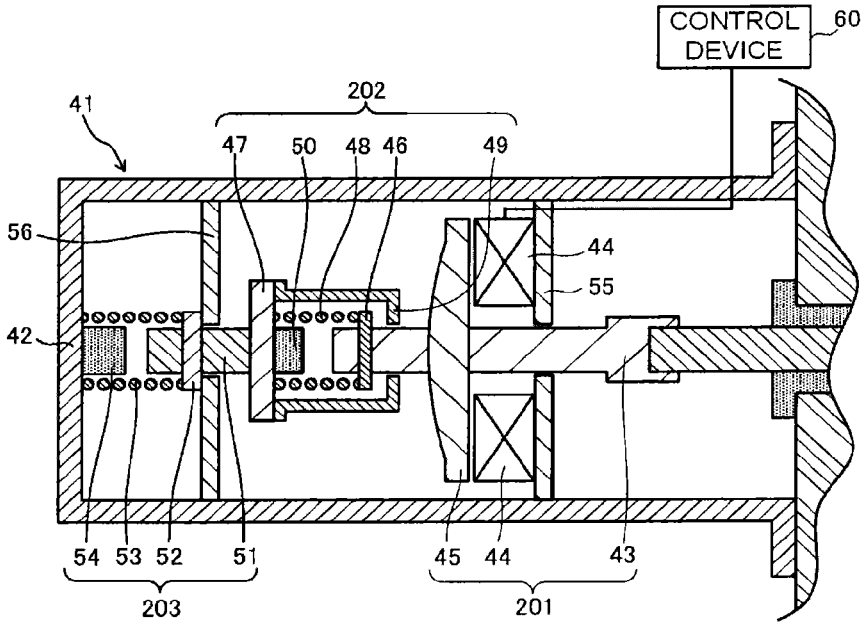
FIG. 9 is an enlarged fragmentary cross-sectional view illustrating an electromagnetic repulsion operation part of the vacuum circuit breaker in FIG. 8, and illustrates the closed state.

As illustrated in FIG. 8 and FIG. 9, the electromagnetic repulsion operation part 41 has a mechanism box 42, a high-speed opening part 201, a wiping mechanism part 202, and a reflection mechanism part 203.

The mechanism box 42 is a box having a hollow inner part, with its one end surface opened and with an opening edge of the end surface fixedly connected to a wall surface of a pressure vessel 1 on which a sealing part 16 is provided.

Members of the high-speed opening part 201, the wiping mechanism part 202, and the reflection mechanism part 203 are housed in this mechanism box 42.

The high-speed opening part 201 includes a first movable shaft 43, an electromagnetic repulsion coil 44, and a repulsion ring 45. The first movable shaft 43 is a rod-shaped body connected to an operation rod 15.

A support part 55 is fixed on an inner wall of the mechanism box 42, and the support part 55 extends toward the first movable shaft 43.

The support part 55 is a coil fixing part which fixes the electromagnetic repulsion coil 44.

The electromagnetic repulsion coil 44 is made of a conductor and is disposed on the support part 55 so as to face the repulsion ring 45.

That is, the electromagnetic repulsion coil 44 is fixed to the pressure vessel 1 directly or via another member (support part 55).

The repulsion ring 45 is an annular body made of a magnetic material, and in its annular hole, the first movable shaft 43 is fit, and the repulsion ring 45 is fixed to a periphery of the first movable shaft 43.

That is, the repulsion ring 45 is disposed on the electromagnetic repulsion coil 44 opposite the pressure vessel 1, to face the electromagnetic repulsion coil 44.

A control device 60 is connected to the electromagnetic repulsion coil 44. The control device 60 functions as an exciting part which excites the electromagnetic repulsion coil 44 by supplying an exciting current thereto.

The electromagnetic repulsion coil 44 is excited by the exciting current supplied from the control device 60 to give an electromagnetic repulsive force to the repulsion ring 45, so that the first movable shaft 43 is moved (driven) in such a direction as to get out of the pressure vessel 1 (in such a direction as to open a contact of a vacuum valve 8).

The wiping mechanism part 202 transmits the electromagnetic repulsive force of the high-speed opening part 201 to the reflection mechanism part 203.

This wiping mechanism part 202 includes: a collar 46 fit to the first movable part 43; a coupling 47 made of an insulating material; wiping springs 48 (first springs) disposed between the collar 46 and the coupling 47; a collar presser 49 which presses the collar 46; a first shock absorber 50 which alleviates a shock when the first movable shaft 43 collides; and a second movable shaft 51 fixed to the coupling 47.

The coupling 47 is a flat disk-shaped member, for instance, and is disposed to face the collar 46.

The wiping springs 48 each have one end connected to the collar 46 and the other end connected to the coupling 47 in a state where a biasing force is applied to the collar 46 and the coupling 47.

The collar presser 49 is a cylindrical bottomed body.

The collar presser 49 is fixed to the coupling 47 so as to surround the collar 46 and the wiping springs 48, and its bottom surface plays a role of a stopper of the collar 46.

Incidentally, an opening is provided in a side portion (bottom portion) of the collar presser 49, and the first movable shaft 43 is movable (insertable) through this opening.

The first shock absorber 50 is fixed to a portion, of the coupling 47, on which the moving first movable shaft 43 abuts (position coaxial with the second movable shaft 51).

The first movable shaft 43 transmits a thrust to the second movable shaft 51 directly or via another member (coupling 47) while a force of the collision with the second movable shaft 51 is absorbed.

The second movable shaft 51 is a rod-shaped body fixed to the coupling 47 and extends toward the reflection mechanism part 203.

The reflection mechanism part 203 includes: a collar 52 fit to the second movable shaft 51; reflection springs 53 (second springs) inserted between the collar 52 and the mechanism box 42; and a second shock absorber 54 which alleviates a shock when the second movable shaft 51 collides.

A support part 56 is fixed to the inner wall of the mechanism box 42, and the support part 56 extends toward the second movable shaft 51.

The reflection springs 53 each have one end connected to the collar 52 and the other end connected to the mechanism box 42 in a state where a biasing force is applied to the collar 52 and the mechanism box 42.

The collar 52 is a restricting member which restricts the movement of the second movable shaft 51 in the mechanism box 42 within a predetermined range.

The second shock absorber 54 is fixed to a portion, of the mechanism box 42, on which the moving second movable shaft 51 abuts, and absorbs a shock of the collision of the second movable shaft 51.

These first shock absorber 50 and second shock absorber 54 are members using a polymeric material such as rubber or plastic resin, for instance.

Alternatively, the first shock absorber 50 and the second shock absorber 54 may be structures in which metal plates are stacked.

Hereinafter, the operation of the second embodiment will be described.

(Opening Operation)

First, an opening operation of the electromagnetic repulsion operation part 41 in the process of a contact opening/closing operation of the switch of the second embodiment will be described.

When the control device 60 receives an opening command from the outside in a closed state where a fixed electrode 11 and a movable electrode 14 of a vacuum valve 8 are in contact with each other as illustrated in FIG. 8 and FIG. 9, the control device 60 supplies a current to the electromagnetic repulsion coil 44 for a short time, so that the electromagnetic repulsion coil 44 is excited only for this time.

Figure 10:
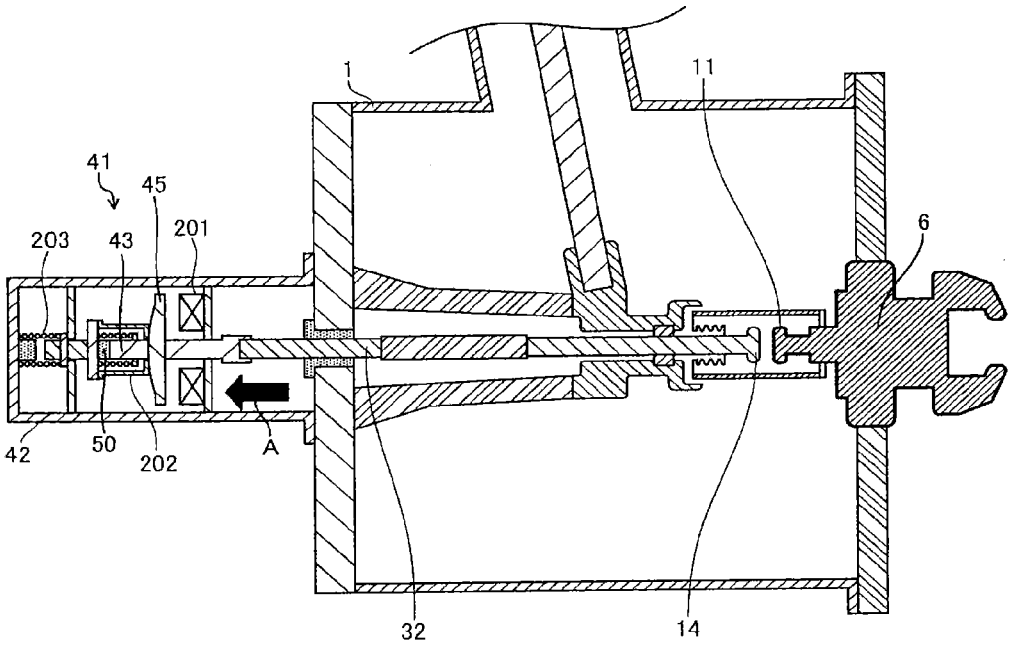
FIG. 10 is a view illustrating a behavior of a high-speed opening part at the time of an opening operation in the switch of the second embodiment.

By this excitation, an electromagnetic repulsive force is generated in the repulsion ring 45, and as illustrated in FIG. 10, the repulsion ring 45 moves in an arrow A direction (opening direction) opposite the pressure vessel 1, and the movable electrode 14 coupled via the coupling part 32 to the first movable shaft 43 to which the repulsion ring 45 is fixed performs, at a high speed, the opening operation from the fixed electrode 11 in a direction toward the electromagnetic repulsion operation part 41 (hereinafter, referred to as an opening direction in the vacuum circuit breaker 7. Further, the reverse direction to this direction will be referred as a closing direction).

By this operation, the first movable shaft 43 moves in the opening direction, and the collar 46 compresses the wiping springs 48 and collides with the first shock absorber 50.

Figure 11:
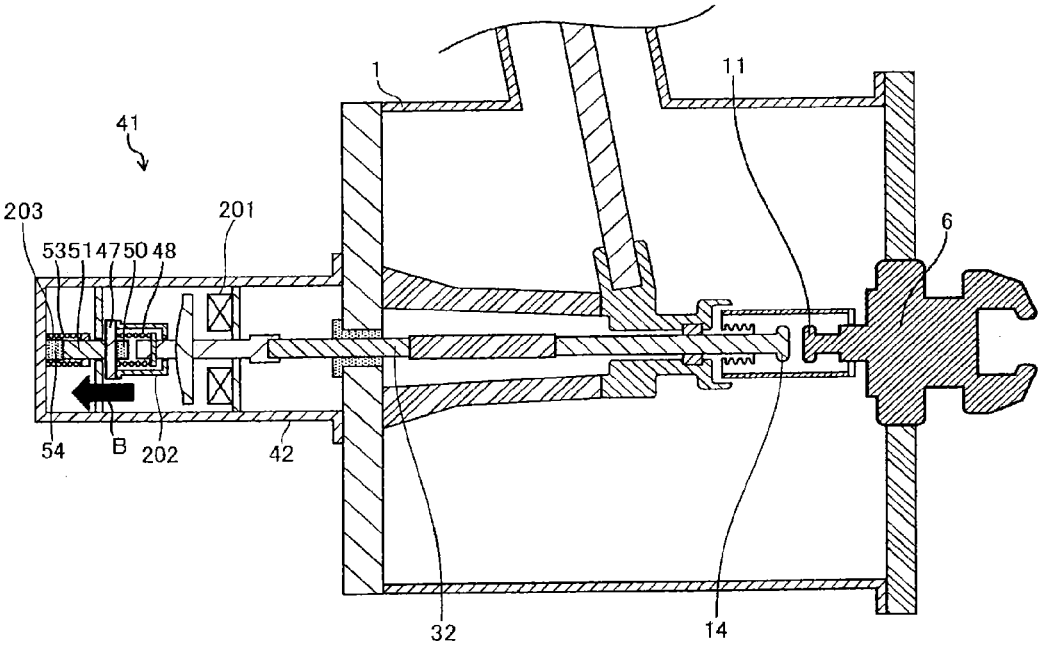
FIG. 11 is a view illustrating a behavior of a wiping mechanism in the second embodiment.

At this time, the first movable shaft 43 pushes the coupling 47 and the second movable shaft 51 in the opening direction B via the wiping springs 48 and the first shock absorber 50 as illustrated in FIG. 11 while its impact force is alleviated by a shock absorbing operation of the first shock absorber 50.

The second movable shaft 51 pushed in the opening direction moves in the opening direction, so that the collar 52 compresses the reflection springs 53 and collides with the second shock absorber 54.

Figure 12:
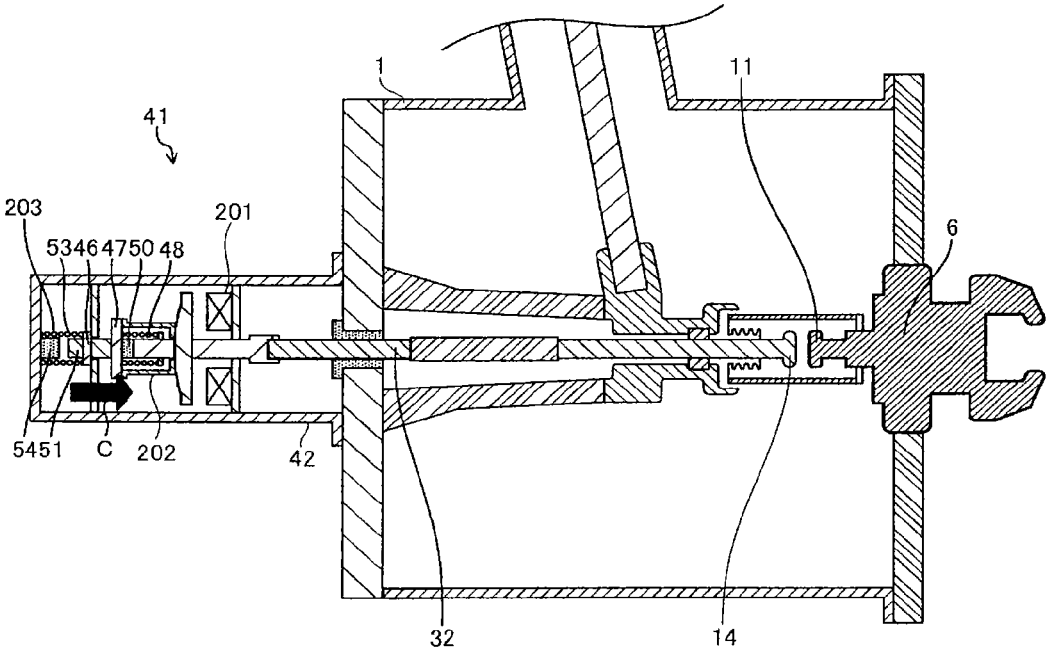
FIG. 12 is a view illustrating a behavior of a reflection mechanism part in the second embodiment.

At this time, the reflection springs 53 are pressed to contract while kinetic energy of the second movable shaft 51 in the opening direction is absorbed by the first shock absorber 50, and as illustrated in FIG. 12, by a repulsive force (biasing force) of the contracted reflection springs 53, the second movable shaft 51 and the coupling 47 are pushed back in the closing direction C.

The second movable shaft 51 which is pushed back moves in the closing direction, and by this movement, the first shock absorber 50 collides with the first movable shaft 43 while the coupling 47 compresses the wiping springs 48.

Figure 13:
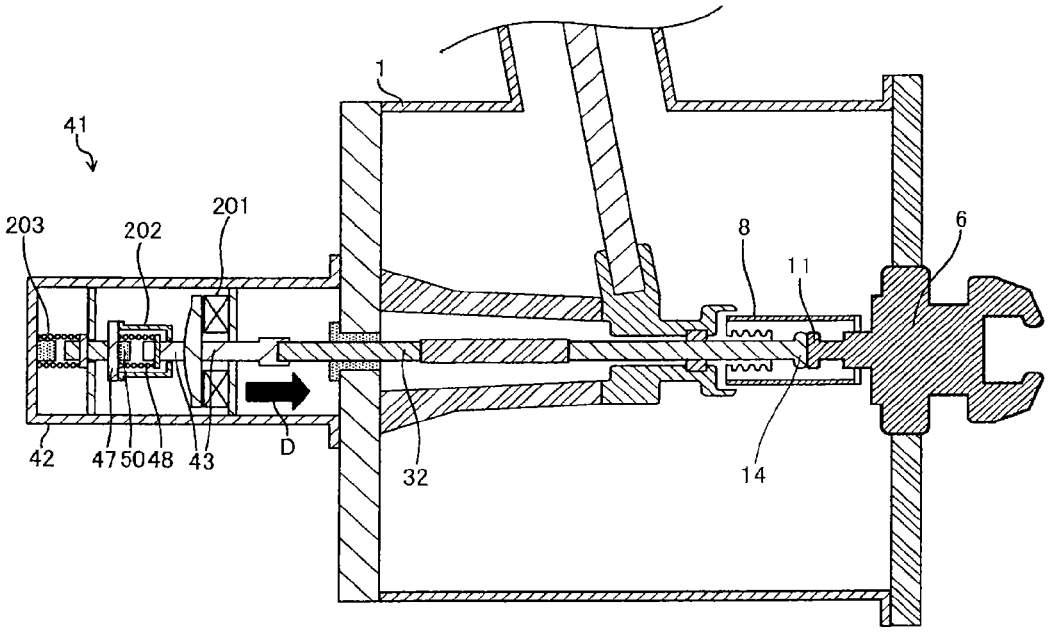
FIG. 13 is a view illustrating a closing operation of the vacuum circuit breaker in the second embodiment.

An impact force at this time and the biasing force of the wiping springs 48 push back the first movable shaft 43 in the closing direction D as illustrated in FIG. 13.

The first movable shaft 43 which is pushed back moves in the closing direction D, so that the movable electrode 14 coupled thereto via the coupling part 32 abuts on the fixed electrode 11, so that the contact of the vacuum valve 8 is closed.

As described above, after the first movable shaft 43 transmits the kinetic energy to the second movable shaft 51, the second movable shaft 51 reverses its operation direction, and the vacuum valve 8 keeps the open state until the kinetic energy is transmitted to the first movable shaft 43, and thereafter is closed.

(Closed State)

FIG. 8 illustrates a closed state, and in this closed state, the biasing force of the wiping springs 48 is applied to the movable electrode 14 of the vacuum valve 8 via the first movable shaft 43 and the coupling part 32.

Therefore, the movable electrode 14 is in contact with the fixed electrode 11 of the vacuum valve 8 while biased by the wiping springs 48, so that the closed state is maintained.

Therefore, even when a slight vibration or the like occurs, the movable electrode 14 does not part from the fixed electrode 11, which can prevent electric chattering or the like.

Here, in the closed state where the fixed electrode 11 and the movable electrode 14 of the vacuum valve 8 are in contact with each other, a predetermined gap is provided between the collar 46 and the collar presser 49.

(Effects)

According to the second embodiment, in addition to the same operations and effects as those of the first embodiment, the following operations and effects are exhibited Specifically, in the second embodiment, the operation part 29 on the vacuum circuit breaker 7 side is formed as the electromagnetic repulsion operation part 41, and accordingly in the vacuum circuit breaker 7, a stroke being a movement distance of the contact of the movable electrode 14 necessary for the current interruption is short and the weight of the movable members is small, which makes it possible to obtain high responsiveness in the opening operation and to further shorten the interruption time.

In particular, in this second embodiment, since the high-speed opening part 201 composed of the electromagnetic repulsion coil 44, the support part 55 fixing the electromagnetic repulsion coil 44, and the repulsion ring 45 provided to face the electromagnetic repulsion coil 44 is provided in the electromagnetic repulsion operation part 41, the electromagnetic repulsion operation part 41 performs the opening operation by the electromagnetic repulsive force working between the excited electromagnetic repulsion coil 44 and the repulsion ring 45, and therefore, as compared with an operation part whose driving source is a spring force or a hydraulic pressure, the driving force rises very quickly, so that very high responsiveness can be obtained.

Therefore, the current interruption in a very short time is enabled.

Further, the mechanism which constantly gives a certain force to the contact of the vacuum valve 8 is provided in the electromagnetic repulsion operation part 41.

Concretely, by continuously applying the biasing force of the wiping springs 48 to the movable electrode 14 in the vacuum valve 8 via the first movable shaft 43 and the coupling part 32, the force causing the movable electrode 14 to continuously press the fixed electrode 11 of the vacuum valve 8 occurs, which makes it possible to obtain the effect such as the prevention of the chattering at the contact of the vacuum valve 8.

Further, since, in the electromagnetic repulsion operation part 41, the reflection mechanism part 203 which transmits and pushes back the force by the two springs and the movable shaft is provided, the open state of the contact of the vacuum valve 8 is maintained for a predetermined time after the opening operation (for a time up to the opening of the other contact 10), and immediately thereafter, the closing operation is performed, and accordingly, there is no need for separately providing a mechanism exclusively for the closing purpose, which can realize simplification, downsizing, and cost reduction of an internal mechanism of the operation part 29.

Third Embodiment (Structure)

A basic structure of a third embodiment is the same as that of the second embodiment.

Only what are different from the second embodiment will be described, and the same parts as those of the second embodiment will be denoted by the same reference signs, and detailed description thereof will be omitted.

Figure 14:
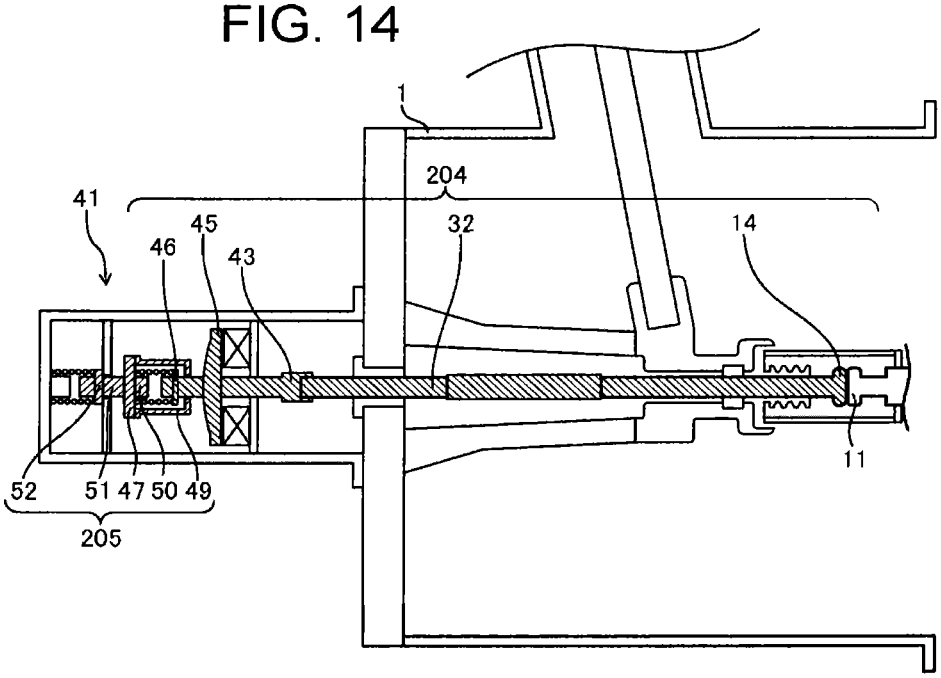
FIG. 14 is an enlarged view illustrating the structure of a vacuum circuit breaker side of a switch according to a third embodiment.

As illustrated in FIG. 14, in the third embodiment, weights are allocated to respective components so that a mass of a first movable part 204 including a movable electrode 14 of a vacuum valve 8, a coupling part 32, a first movable shaft 43, a repulsion ring 45, a collar 46, and so on becomes equal to a mass of a second movable part 205 including a coupling 47, a collar presser 49, a first shock absorber 50, a second movable shaft 51, a collar 52, and so on.

(Operations and Effects)

In this third embodiment, in an opening operation, the speed of the first movable part 204 after it collides with the second movable part 205 is preferably low.

In particular, the movement of the first movable part 204 in a closing direction after the collision would cause the movable electrode 14 indirectly coupled to the first movable part 204 to move in the closing direction and reduce a distance between contacts of the vacuum valve 8, and thus should be avoided.

Here, the first movable part 204 and the second movable part 205 are regarded as rigid bodies Here, let the mass of the first movable part 204 be m1 and its speeds before and after the collision be v1, v1' respectively.

Let the mass of the second movable part 205 be m2 and its coefficient of restitution be e.

In this case, the speed v1' of the movable part 204 after the collision is $$v1'=(m1-m2e)/(m1+m2)\times v1.$$

When m1<m2, v1'<0.

This means that the movable electrode 14 moves in the closing direction after the collision and thus is not preferable.

On the other hand, when m1 is increased, v1' becomes higher, and therefore m1 is preferably as small as possible. From the above two points, m1=m2 is the most preferable.

As described above, according to the third embodiment, in addition to the same operations and effects as those of the first embodiment, the distance between the contacts of the vacuum valve 8 at the time of the opening operation is easily controlled, which makes it possible to provide a highly reliable switch.

Fourth Embodiment (Structure)

A basic structure of a fourth embodiment is the same as that of the second embodiment.

Only what are different from the second embodiment will be described, and the same parts as those of the second embodiment will be denoted by the same reference signs, and detailed description thereof will be omitted.

In the fourth embodiment, reflection springs 53 whose biasing force is larger than that of wiping springs 48 in a closed state is used.

That is, the biasing force of the reflection springs 53 (second springs) in the closed state is set larger than the biasing force of the wiping springs 48 (first springs).

(Operations and Effects)

In the second embodiment, if the biasing force of the reflection springs 53 in the closed state is smaller than the biasing force of the wiping springs 48, a position of the movable part 205 is decided by a balance between the biasing force of the reflection springs 53 and the biasing force of the wiping springs 48.

If so, after the opening operation, the position of the movable part 205 also fluctuates due to vibration or the like of these springs.

This also influences the biasing force of the wiping springs 48, which is liable to lead to chattering of a contact of a vacuum valve 8 or a change in contact resistance.

Therefore, in the fourth embodiment, by setting the biasing force of the reflection springs 53 in the closed state larger than the biasing force of the wiping springs 48, the movable electrode 14 is constantly kept biasing (pressing) a fixing electrode 11 in the vacuum valve 8, and therefore, the positions of the first movable part 204 and the second movable part 205 are uniquely decided and an influence on the contact of the vacuum valve 8 is also eliminated, which makes it possible to provide a highly reliable switch.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A switch comprising:

a hermetic vessel filled with an insulating medium;

an insulating spacer dividing the hermetic vessel into a first hermetic space and a second hermetic space;

an electrode disposed at the insulating spacer, configured to penetrate through the insulating spacer;

a first conductor led into the first hermetic space;

a second conductor led into the second hermetic space;

a first circuit breaker part which inserted a first conductor and the electrode in the first hermetic space and connecting the first conductor and the electrode in a closed state;

a second circuit breaker part which inserted a second conductor and the electrode in the second hermetic space and connecting the second conductor and the electrode in a closed state; and wherein the first circuit breaker part has a first contact including the electrode and a first driver which drives the first contact to open/close;

wherein the second circuit breaker part has a second contact including the electrode and a second driver which drives the second contact to open/close;

wherein the first circuit breaker part are a vacuum circuit breaker in which the first contact is housed in a vacuum vessel;

wherein the second circuit breaker part has the second contact larger in dielectric strength than the first contact in the vacuum circuit breaker; and wherein, when performing an interrupting operation from the closed state, the first driver and the second driver open the first contact and the second contact, and the first driver waits for the second contact of the second circuit breaker part to open and then closes the first contact of the vacuum circuit breaker.

2. The switch according to claim 1, wherein the first driver includes:

a coil;

a coil fixing part fixing the coil to the hermetic vessel directly or via another member;

a magnetic body disposed on a side of the coil opposite the hermetic vessel to face the coil; and a first movable shaft fixed to the facing magnetic body so as to penetrate through the magnetic body and the coil; and wherein an exciting part is provided which opens the first contact of the vacuum circuit breaker by a thrust of the first movable shaft generated by excitation of the coil.

3. The switch according to claim 2, wherein the first driver includes:

a mechanism box;

a second movable shaft held in the mechanism box on an opposite side of the first contact of the vacuum circuit breaker so as to be coaxial with the first movable shaft and so as to be movable in an axial direction independently of the first movable shaft;

a restricting member which is provided on the second movable shaft to restrict the movement of the second movable shaft in the mechanism box within a predetermined range;

a first spring inserted between the first movable shaft and the second movable shaft so as to separate the both movable shafts with a predetermined interval at a normal time and so as to enable the both movable shafts to come into contact with each other when the thrust in a direction toward the second movable shaft is applied to the first movable shaft; and a second spring inserted between a wall surface, of the mechanism box, that is located in a direction in which a shaft end of the second movable shaft moves, and the restricting member of the second movable shaft, wherein, when the first contact of the vacuum circuit breaker part is opened, the second spring is compressed by a force transmitted via the first movable shaft and the second movable shaft; and wherein the second movable shaft and the first movable shaft are pushed back by a repulsive force of the compressed second spring to close the first contact of the vacuum circuit breaker.

4. The switch according to claim 3, wherein, in the vacuum circuit breaker, a mass of a first movable part including a first movable electrode, the first movable shaft, a coupling part connecting the first movable electrode and the first movable shaft, and the magnetic body is equal to a mass of a second movable part including the second movable shaft, the restricting member, and a first shock absorber.

5. The switch according to claim 3, wherein, in the closed state, a biasing force of the second spring is larger than a biasing force of the first spring.

6. The switch according to claim 3, wherein the first driver includes a first shock absorber which absorbs a force generated when the moving first movable shaft collides with the second movable shaft directly or via another member.

7. The switch according to claim 3, wherein the first driver includes a second shock absorber which is fixed to a portion, of the mechanism box, on which the moving second movable shaft abuts and which absorbs a force generated when the second movable shaft collides with the mechanism box.

8. The switch according to claim 6, wherein the first shock absorber is a member using a polymeric material.

9. The switch according to claim 7, wherein the second shock absorber is a member using a polymeric material.

10. The switch according to claim 6, wherein the first shock absorber is a structure in which metal plates are stacked.

11. The switch according to claim 7, wherein the second shock absorber is a structure in which metal plates are stacked.

12. The switch according to claim 1, wherein the insulating medium is SF6 gas.

* * * * *